US005578232A

United States Patent [19]

Engelke

[11] Patent Number: 5,578,232

[45] Date of Patent: Nov. 26, 1996

[54] OPEN-COIL HEATER ASSEMBLY AND INSULATOR THEREFOR

[75] Inventor: Roger P. Engelke, Huntsville, Ala.

[73] Assignee: Hart & Cooley, Inc., Holland, Mich.

[21] Appl. No.: 434,951

[22] Filed: May 4, 1995

[51] Int. Cl.[6] ..... H05B 3/06

[52] U.S. Cl. ..... 219/532; 219/536; 219/537; 219/546; 219/550; 338/317; 338/318; 338/299; 338/267

[58] Field of Search ..... 219/532, 536, 219/537, 546, 550; 174/138.5; 338/317, 299, 318, 267

[56] References Cited

U.S. PATENT DOCUMENTS

| | | | |
|---|---|---|---|
| D. 248,943 | 8/1978 | King . | |
| D. 262,285 | 12/1981 | Janning . | |
| 1,419,309 | 6/1922 | Russell . | |
| 1,695,801 | 12/1928 | Dibble . | |
| 2,014,001 | 8/1933 | Knapp et al. | 219/536 |
| 2,162,341 | 6/1939 | Adam | 219/536 |
| 2,856,500 | 10/1958 | Hartman . | |
| 2,963,539 | 12/1960 | Hynes | 174/138 J |
| 3,691,348 | 9/1972 | Kunz . | |
| 3,846,619 | 11/1974 | Wightman et al. . | |
| 3,890,487 | 6/1975 | Wightman et al. . | |
| 3,992,609 | 11/1976 | Alexander . | |
| 4,250,399 | 2/1981 | King | 219/532 |
| 4,268,742 | 5/1981 | Cottrell et al. . | |
| 4,363,959 | 12/1982 | Cottrell et al. . | |
| 5,051,563 | 9/1991 | Muller | 219/535 |
| 5,122,640 | 6/1992 | Holmes | 219/532 |
| 5,124,534 | 6/1992 | Williams et al. | 219/532 |
| 5,187,771 | 2/1993 | Uchida | 219/532 |

FOREIGN PATENT DOCUMENTS

| | | | |
|---|---|---|---|
| 158767 | 2/1933 | Switzerland | 219/536 |
| 214058 | 3/1924 | United Kingdom . | |
| 1003610 | 9/1965 | United Kingdom . | |

*Primary Examiner*—Teresa J. Walberg
*Assistant Examiner*—Karl Easthom
*Attorney, Agent, or Firm*—Varnum, Riddering, Schmidt & Howlett LLP

[57] ABSTRACT

An open coil electric heater comprising a rigid support frame composed of a pair of longitudinally extending, laterally spaced members, with cross members between and secured to the longitudinal members. The cross members carry ceramic insulator members which are detachably connected to the cross members. Each insulator member has an end formed with a slot at an acute angle to the side walls of the insulator member to pass a portion of a convolution of an electrical wire coil. Hook-like projections form a transverse indentation at the base of the slot to detachably hold the portion of the wire om the insulator member. The portion of the wire is secured to the insulator members in an expeditious manner and without the use of tools by twisting the wire portion so that the wire portion is aligned sufficiently with the slot to enable the coil to freely pass into said slot. The coil then springs back to a transverse orientation so that the coil portion fits against opposite side faces of the transverse indentation and is held in position by the hook-like projections.

14 Claims, 3 Drawing Sheets

OPEN-COIL HEATER ASSEMBLY AND INSULATOR THEREFOR

BACKGROUND OF THE INVENTION

1. Field of the Invention

This invention relates to an open-coil heater assembly and, more specifically, to an open-coil heater assembly having a helically-coiled heating element supported by insulators.

2. Description of Related Art

U.S. Pat. No. 3,846,619, issued Nov. 5, 1974, discloses on open-coil electric heater in which a helically coiled electrical resistance wire is supported on a metal support through ceramic insulators. The ceramic insulators are configured to receive metal clips to support the ceramic insulators and have slots at the ends thereof to receive and hold a portion of the coiled resistance wire.

U.S. Pat. No. 4,250,399, issued Feb. 10, 1981, discloses an open-coil electric heater wherein an electrical resistance heater coil is supported on a ceramic insulator which has a vertical slot extending transverse to side walls from an end portion of the insulator. The side walls have a lip formed from an undercut on each side to retain a coil portion at an acute angle to the side walls. The wire must be twisted to fit through the transverse slot.

SUMMARY OF INVENTION

According to the invention, an open-coil heater assembly comprises a metal support member, a helically-coiled resistance wire connected to and supported by the support member at a number of places and an insulator member at each of the places for electrically insulating the resistance wire from the support member. Each of the insulator members is molded of refractory material and has a portion generally rectangular in transverse cross section to provide generally flat, parallel, opposed, side surfaces. An insulator portion of the insulator member has a slot extending inwardly from an end thereof and from one to the other of the opposed surfaces at an acute angle thereto. The slot is sized and arranged to freely pass and receive a portion of the resistance wire between adjoining convolutions without hindrance from the defining walls of the slot when the resistance wire portion is in alignment with the slot. A transverse indentation extends laterally of the slot and is spaced inwardly of the insulator portion transversely of the opposed surfaces. The indentation is formed by a retaining lip between the slot in one of the opposed surfaces. The resistance wire portion after being inserted in the slot can move to a transverse position within the transverse slot and be retained therein by the retaining lip. Preferably, there are two of the transverse indentations, one on each side of the insulating portion.

In a preferred embodiment of the invention, the insulator member is formed of two substantially identical modules, each module forming a portion of the slot and having one of the transverse indentations. Each of the insulator modules has one of the side surfaces and is joined to the other module through a central surface parallel to a respective side surface. Each of the modules has an indexing indentation and an indexing protrusion. The indexing indentation of one module is in register with an indexing protrusion, and vice versa, when the two modules are positioned together to form the insulator member. Each of the insulator modules is symmetrical about a horizontal plane except for the indexing indentation and protrusion.

The retaining lip is formed by a hook-shaped flange at the end of the insulator portion. The hook-shaped flange has a vertical wall at an acute angle to the opposed surfaces and forming a wall of the slot. Preferably, two hook-shaped flanges define the slot and the retaining lips.

Further according to the invention, an insulator member for use in an open-coil heater assembly having a helically-coiled resistance wire joined to a support member through the insulator member is formed from a molded refractory material having a portion generally rectangular in cross section to provide generally flat, parallel, opposed, side surfaces. An insulator portion of the insulator member has a slot extending inwardly from an end thereof and from one to the other of the opposed surfaces at an acute angle thereto. The slot is sized and arranged to freely pass and receive a portion of a resistance wire between adjoining convolutions without hindrance from the defining walls of the slot when the resistance wire portion is aligned with the slot. A transverse indentation extends laterally of the slot, spaced inwardly of the end of the insulator portion and transversely of the opposed surfaces. The transverse indentation is formed by a retaining lip between the slot and one of the opposed surfaces. Preferably, the retaining lip is formed by a hook-shaped flange which has a vertical wall at an acute angle to the opposed side surfaces and forming a wall of the slot.

BRIEF DESCRIPTION OF THE DRAWINGS

The invention will now be described with reference to the drawings wherein.

DESCRIPTION OF THE PREFERRED EMBODIMENTS

Figure 1:
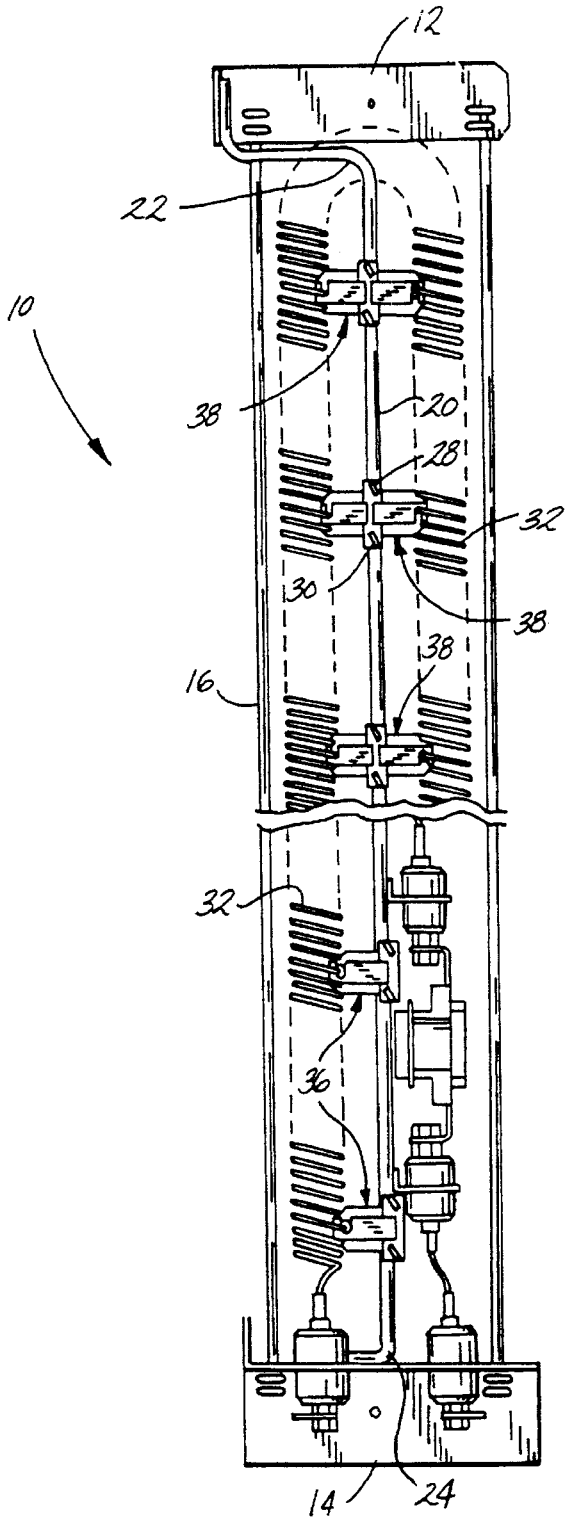
FIG. 1 is a top plan view of an open coil electric heater assembly according to the invention.
Figure 2:
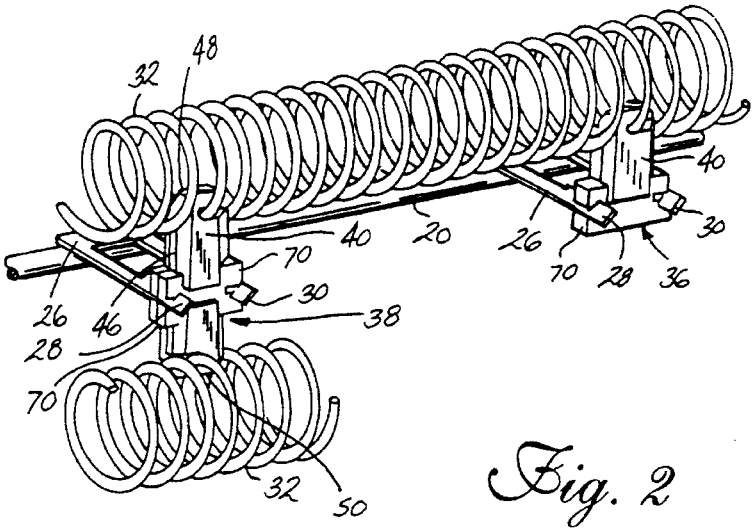
FIG. 2 is a perspective view of a portion of the heater assembly shown in FIG. 1.

Referring now to the drawings and to FIGS. 1 and 2 in particular, an open-coil heater shown generally at 10 includes a first mounting plate 12 and a second mounting plate 14 connected by a pair of steel rods 16 and 18. The rods 16 and 18 are connected to the undersides of the mounting plates 12 and 14 to extend therefrom in a common plane and in parallel, laterally spaced relation. This connection may be effected by welding the rods to the plate.

A suspension rod 20 is connected between the central points of the mounting plates 12 and 14. The suspension rod 20 includes curved leg portions 22 and 24 which provide greater surface area for mounting to the mounting plates 12 and 14. As seen in FIG. 2, the suspension rod 20 is constructed and arranged to support insulator clips 26. The insulator clips 26 are spaced along and extend vertically upward from the suspension rod 20. Each insulator clip 26 is in the form of an oblong metal body or any other suitable rigid material. Each insulator clip 26 is preferably rectangular in cross section and includes two angular prongs 28 and 30 extending transversely parallel outward from the major sides of the clip to define an opening.

Insulators 36, 38 are mounted in the openings in the insulator clips. An electrical resistance heater coil 32 is mounted to the suspension rod 20 through the insulators 38 and 36 and the insulator clips 26.

Figure 3:
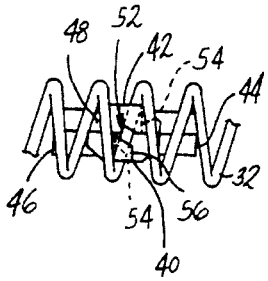
FIG. 3 is a top plan view of a portion of the heater assembly shown in FIG. 1.
Figure 4:
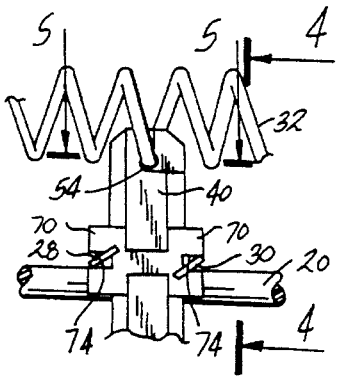
FIG. 4 is a front elevational view of a portion of the heater assembly shown in FIG. 1.
Figure 5:
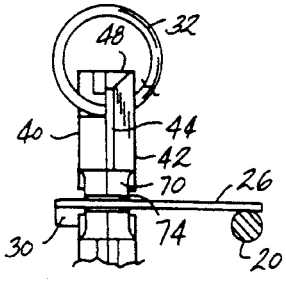
FIG. 5 is a side elevational view along the lines 5—5 of FIG. 4.
Figure 6:
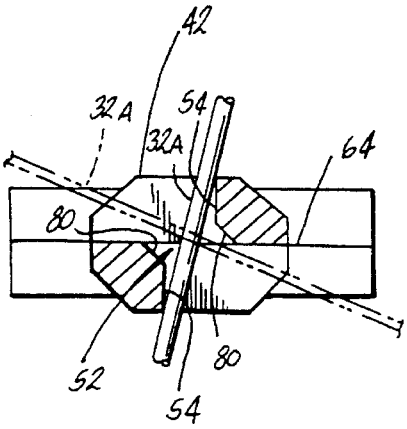
FIG. 6 is a slightly enlarged, fragmentary, top plan view taken along lines 6—6 of FIG. 4, showing the manner in which a portion of the coil is inserted into the insulator and retained therein.

Referring now to FIGS. 2–6, each of the insulators 38 is molded of a refractory material and has a portion generally rectangular in transverse cross section to provide generally flat, parallel, opposed, side walls 40 and 42, and side edges 44 and. 46. The insulator further has a substantially identical top end 48 and bottom end 50. Each end 48 and 50 has a slot 52 extending inwardly from an end portion and from one of the side walls 40 to the other side wall 42 at an acute angle to the side walls. As seen in FIGS. 3 and 6, the slot 52 is sized and arranged to freely pass and receive a portion 32A of the coil 32 between adjoining convolutions to permit the coiled resistance wire to extend at an acute angle to and from the opposed side walls 40 and 42. Thus, the wire portion 32A can be moved to a position within the slot without hindrance from the defining walls of the slot by positioning the resistance wire portion 32A in alignment with the slot 52.

A transverse indentation 54 extends laterally of the slot and transversely of opposed side walls 40 and 42 and is formed at the bottom of the slot 52 at each side of the insulator 32 by a retaining lip 56. Thus, the transverse indentations 54 form a transverse passage for resting of the heating coil portion 32A within the insulator 38. The top and bottom of the insulator 38 are essentially the same and retain a portion of the heater coil 32 in exactly the same manner.

The insulator 36 is identical to the insulator 38 except that it does not have a bottom portion.

Figure 7:
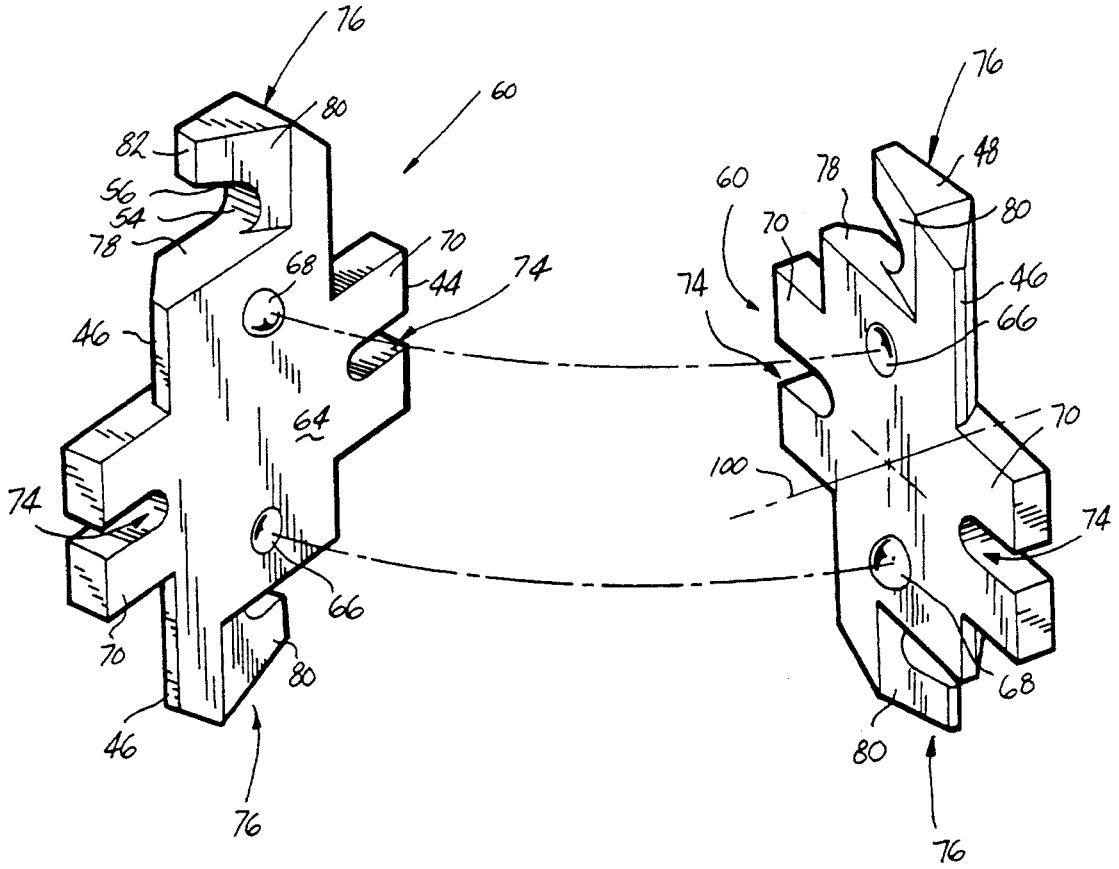
FIG. 7 is a perspective exploded view of two modules which form the insulators shown in FIGS. 1–6 showing the assembly of a heating coil clip.

As seen more clearly in FIG. 7, each insulator 38 is formed from two identical modules 60. Each module has an interior surface 64 with a hemispherical recess 66 in a central portion of one end thereof and a hemispherical bead 68 at a central portion of another end thereof. U-shaped flanges 70 extend laterally from side edges 44, 46 to define a channel 74 for receipt of the prongs 28 and 30. A hook-shaped flange 76 extends vertically upwardly from the top edge 78 to form the retaining lip 56. The hook-shaped flange 76 has a slanted wall 80 which extends from the interior surface 64 toward a respective side wall 40 or 42 and at an acute angle thereto. The slanted walls 80 thus provide the walls of the slot 52. Hook-shaped flanges 76 have terminal ends 82 which extend beyond the lateral midpoint of the top edge 78 and define the transverse indentation 54 for receiving the portion 32A of the heating coil. Each module 60 is identical in shape and size. To connect two modules 60 together, one module is rotated 180° with respect to the other module about a horizontal axis 100 passing perpendicular to the interior surface 64 in order to align the beads 68 with the recesses 66. Thus, the beads 68 and the recesses 66 provide indexing of the two modules for proper alignment with one another and assembly into the heater coil assembly. As illustrated in FIGS. 3, 5, 6 and 7, the insulator modules 60 are symmetrical when rotated 180° about a horizontal axis 100 perpendicular to interior surface 64 except for the recess 66 and bead 68.

The modules 60 are joined together with the surfaces 64 flat against each other, the bead 68 of one module being received within the recess 66 of an opposing module. The thus joined modules are inserted into the opening in the insulator clips 26. The angular prongs 28 and 30 are then bent to retain the modules in the position illustrated in FIGS. 1–5.

The coil is installed into the insulators assembly by flexing a portion 32A of the coil at an acute angle to the side walls 40 and 42 so that the portion 32A is aligned with the slot 52 as illustrated in phantom lines in FIG. 6. The coil portion is then pushed downwardly (in the case of the upper end) or upwardly (in the case of the lower end) into the slot until the heating coil portion 38 strikes the top edge 78. The coil portion 32A is then released so that it springs into the slots 52, transverse to the side walls 40 and 42 and retained by the retaining lips 56 as illustrated in full lines in FIG. 6. This process is followed until a portion of the coil 32 is positioned in each of the insulators 36 or 38. The same process is followed for insulator 36. Removal of the heater coil takes place by the opposite procedure, i.e., rotating the heater coil portion 32A to an acute angle as illustrated in phantom lines in FIG. 6 so that it can be pulled upwardly through the open slot 52.

The invention provides an inexpensive and very effective insulator for a heating coil. The heating coil can be easily assembled in place with a single-coil portion in each insulator block.

Reasonable variation and modification are possible within the scope of the foregoing disclosure and drawings without departing from the spirit of the invention which is defined in the appended claims.

What we claim is:

1. An open-coil heater assembly comprising:

a metal support member;

a helically coiled resistance wire connected to and supposed by said support member at a plurality of places;

an insulator member at each of said places for electrically insulating said resistance wire from said support member, each insulator member being of molded refractory material and having a portion defining generally flat parallel opposed side surfaces;

the insulator portion having a slot defined by a pair of slot defining walls and extending inwardly from an end thereof and from one to the other of said opposed surfaces at an acute angle thereto, said slot being sized and arranged to freely pass and receive a portion of the resistance wire between adjoining convolutions without hindrance from the defining walls of said slot when said wire portion is in alignment with said slot; and a transverse indentation extending laterally of said slot, spaced inwardly of said end of said insulator portion and transversely of said opposed surfaces, said indentation formed by a retaining lip extending between one of the defining walls of said slot and one of said opposed surfaces;

said resistance wire portion resting in said transverse indentation and retained therein by said retaining lip and generally transverse to said opposed surfaces.

2. An open-coil heater assembly according to claim 1 wherein a second transverse indentation extends between the other of the defining walls of said slot and the other of said opposed surfaces.

3. An open-coil heater assembly according to claim 2 wherein said insulator member is formed of two substantially identical modules, each module forming a portion of said slot and having one of said transverse indentations.

4. An open-coil heater assembly according to claim 3 wherein each of said insulator member modules has an indexing indentation and indexing protrusion, the indexing indentation of one of said modules being in register with the indexing protrusion of the other of said modules and vice versa when two of said insulator member modules are positioned together to form said insulator member.

5. An open-coil heater assembly according to claim 4 wherein each of said insulator member modules is symmetrical when rotated 180° about a horizontal axis except for the indexing indentation and protrusion.

6. An open-coil heater assembly according to claim 1 wherein the retaining lip is formed by a hook-shaped flange at the end of the insulator portion.

7. An open-coil heater assembly according to claim 6 wherein the hook-shaped flange has a vertical wall at an acute angle to the opposed side surfaces and forming one of the defining walls of the slot.

8. An insulator member for use in an open-coil heater assembly having a helically coiled resistance wire joined to a support member through the insulator member, the insulator member comprising:

a molded refractory material having a portion defining generally flat parallel opposed side surfaces;

the insulator portion having a slot defined by a pair of slot defining walls and extending inwardly from an end thereof and from one to the other of the opposed surfaces thereto and at an acute angle, said slot being sized and arranged to freely pass and receive a portion of the resistance wire between adjoining convolutions without hindrance from the defining walls of the slot when said wire portion is in alignment with said slot;

a transverse indentation extending laterally of said slot, spaced inwardly of said end of said insulator portion and transversely of said opposed surfaces, said transverse indentation formed by a retaining lip extending between one of the defining walls of said slot and one of said opposed surfaces;

whereby said resistance wire portion can rest in said transverse indentation and be retained therein by the retaining lip in a generally transverse orientation to the opposed surfaces.

9. An insulator member according to claim 8 wherein a second transverse indentation extends between the other of the defining walls of said slot and the other of said opposed surfaces.

10. An insulator member according to claim 9 wherein said insulator member is formed of two substantially identical modules, each module forming a portion of said slot and having one of said transverse indentations.

11. An insulator member according to claim 10 wherein each of said insulator member modules has an indexing indentation and an indexing protrusion, the indexing indentation of one module being in register with respective indexing protrusions of the other module and vice versa when two of said insulator member modules are positioned together to form said insulator member.

12. An insulator member according to claim 11 wherein each of said insulator member modules is symmetrical when rotated 180° about a horizontal axis except for the indexing indentation and protrusion.

13. An insulator member according to claim 8 wherein the retaining lip is formed by a hook-shaped flange at the end of the insulator portion.

14. An insulator member according to claim 13 wherein the hook-shaped flange has a vertical wall at an acute angle to the opposed side surfaces and forms one of the defining walls of the slot.

* * * * *